US006614424B1

(12) United States Patent
Kim et al.

(10) Patent No.: US 6,614,424 B1
(45) Date of Patent: Sep. 2, 2003

(54) APPARATUS AND METHOD FOR TRANSMITTING DATA

(75) Inventors: Seong J. Kim, Seoul (KR); Yu Soong Kim, Inchon-shi (KR); Hyun Chang Lee, Seoul (KR)

(73) Assignee: LG. Philips LCD Co., Ltd., Seoul (KR)

( * ) Notice: Subject to any disclaimer, the term of this patent is extended or adjusted under 35 U.S.C. 154(b) by 0 days.

(21) Appl. No.: 09/572,856

(22) Filed: May 18, 2000

(30) Foreign Application Priority Data

May 18, 1999 (KR) ..... P1999/17902

(51) Int. Cl.[7] ..... G09G 5/00
(52) U.S. Cl. ..... 345/213; 345/94
(58) Field of Search ..... 345/100, 213, 345/94; 348/742, 743, 744, 718, 715

(56) References Cited

U.S. PATENT DOCUMENTS 5,045,951 A * 9/1991 Kimura et al. ..... 347/2
5,574,516 A * 11/1996 Kanai et al. ..... 348/742
5,648,825 A * 7/1997 Kanai et al. ..... 348/715
5,682,112 A * 10/1997 Fukushima ..... 327/144
5,689,536 A * 11/1997 Iyota et al. ..... 331/49
5,835,164 A * 11/1998 Kanai et al. ..... 348/575
5,963,502 A * 10/1999 Watanabe et al. ..... 327/141

* cited by examiner

*Primary Examiner*—Amare Mengistu
(74) *Attorney, Agent, or Firm*—Birch, Stewart, Kolasch & Birch, LLP

(57) ABSTRACT

A data transmitting apparatus and method minimizes the electromagnetic interference (EMI) when transmitting parallel data via transmission lines. A controller receives data inputs synchronized to an input clock signal. The controller frequency-divides the input clock signal by a desired number, and separates the data into a plurality of separated data in such a manner to that one group of separated data has a phase difference relative to another group of separated data and is synchronized to the frequency-divided clock signal. Drive circuits receive the separated groups of data and sample the data at a falling edge or a rising edge of the frequency-divided clock signal such that sampling of one group occurs at different times than sampling of another group.

11 Claims, 12 Drawing Sheets

APPARATUS AND METHOD FOR TRANSMITTING DATA

BACKGROUND OF THE INVENTION

1. Field of the Invention

The present invention relates to a method and apparatus for transmission of parallel data, and more specifically, a method and apparatus for data transmitting apparatus for minimizing the electromagnetic interference (EMI) that is generated during parallel data transmission. Further, the present invention also relates to a liquid crystal display (LCD) device including such a data transmitting apparatus and method.

2. Description of the Related Art

Presently, the video data that is transmitted through a transmission medium includes enlarged content in order to meet the requirements for higher quality images. Further, the data is transmitted at very high speed so that the data can be used at the desired times by a user. Accordingly, the transmission frequency of the video data has been increased and the number of transmission lines to transmit the information has also been increased. However, when video data is transmitted at high frequencies synchronously and simultaneously over the increased data transmission lines, serious problems related to EMI result.

Referring to FIG. 1, there is shown an LCD driving apparatus for transmitting a video data into a direct driving system. The LCD driving apparatus includes source drive integrated circuits (ICs) 12 to drive the source lines of an LCD (not shown). The LCD driving apparatus also includes an LCD controller 10 to control the driving times of the source drive ICs 12. The LCD controller 10 responds to a clock signal MCLK and horizontal and vertical synchronizing signals Hsync and Vsync that are inputted externally to control the driving times of the gate drive ICs (not shown) and the source drive ICs 12. In other words, the LCD controller 10 responds to the input clock signal MCLK and the horizontal and vertical synchronizing signals Hsync and Vsync to output a gate clock signal GCLK and a gate control signal GCS to control the operation of the gate drive ICs.

Referring to FIG. 2, the LCD controller 10 of FIG. 1 responds to an input clock signal MCLK and the horizontal and vertical synchronizing signals Hsync and Vsync to output the red, green and blue data designated as RD, GD and BD that is input into an enable region of a DTMG signal to inform the video data region of the source drive ICs 12. In the above-described case, the LCD controller 10 is synchronized to a source clock signal SCLK which has the same frequency as the input clock signal MCLK along with a source control signal SCS to control the operation of the source drive ICs 12 by transmitting the data RD, GD and BD to the source drive ICs 12.

The source drive ICs 12 sample the RD, GD and BD data that is input by the LCD controller in accordance with the source clock signal SCLK. Since each of the data RD, GD and BD consists of a 6 bit signal, a data bus that is connected to the LCD controller 10 consists of 18 data lines. However, as data RD, GD and BD are synchronously supplied over the 18 data lines, an EMI problem occurs at the data bus. More specifically, as the resolution of the LCD is increased, which means as the number of pixels,is increased, the amount of video data that needs to be transmitted within a unit of time also needs to be increased. For example, when the LCD is in XGA mode, the LCD controller 10 drives all of the input and output clock signals MCLK and SCLK at 65 MHz, thus the source drive ICs 12 inputs or outputs the data RD, GD and BD with the output clock signals so that all of the data is sampled at the above frequency. But, the EMI at the data bus becomes more problematic as the transmission frequency of the video data becomes higher.

In order to overcome the above-mentioned problem, an LCD driving apparatus with a dual-bus driving system as shown in FIG. 3 has been used. Referring to FIG. 3, in order to reduce the EMI that is generated when the video data is transmitted to the source drive ICs 16, the LCD controller 14 is provided with first and second data buses. The LCD controller 14 outputs data RDo, GDo and BDo for the odd-numbered pixels into the source drive ICs 16 over the first data bus while outputting the data RDe, GDe and BDe for the even-numbered pixels into the source drive ICs over the second data bus. In other words, as shown in FIG. 4, the LCD controller 14 divides the RD, GD and BD data that is input externally into odd-numbered pixel data RDo, GDo and BDo and even-numbered pixel data RDe, GDe and BDe in order to output them for the source drive ICs simultaneously. Accordingly the frequency of the source clock signal SCLK and the data that is outputted from the LCD controller 14 is reduced to half of the input frequency, so that the EMI is reduced at the transmission lines that are between the LCD controller 14 and the source drive ICs 16.

Referring to FIG. 5, there is shown a variation of the dual-block driving system of FIG. 3. The LCD driving apparatus of the dual-block driving system as shown in FIG. 5 has also been used in order to reduce the EMI at the data transmission lines. In FIG. 5, the LCD controller 18 also includes first and second data buses like the dual-bus driving system of FIG. 3 to reduce the frequency of the source clock signal SCLK and the data to half of the input frequency. The LCD controller 18 of FIG. 5 outputs the data RDo, GDo and BDo as input for the odd-numbered source drive ICs 20*o* over the first data bus while outputting the data RDe, GDe and BDe as input for the even-numbered source drive ICs 20*e* over the second data bus. In other words, referring to FIG. 6, the LCD controller 18 splits the input data RD, GD, and BD into RDo, GDo, and BDo and RDe, GDe, and BDe as input for odd and even source drive ICs, respectively. Accordingly, the frequency of the source clock signal SCLK and the data that is output from the LCD controller 18 is reduced to half of the input frequency so that the EMI is reduced at the transmission lines that are between the LCD controller 14 and the source drive ICs 16.

However, according to the LCD driving apparatus of the conventional dual-bus and dual-block driving systems, the number of data lines is doubled as the clock and the data frequencies are halved. Further, the data is input synchronously and simultaneously to the data lines so that the EMI problem still exists in the LCD.

SUMMARY OF THE INVENTION

To overcome the problems described above, preferred embodiments of the present invention provide a data transmitting apparatus and method for minimizing the EMI that occurs during parallel data transmission by utilizing a phase difference technique.

A preferred embodiment of the present invention includes a plurality of data signal inputs, a clock signal input having a predetermined frequency, a controller that receives the plurality of data signal inputs and the clock signal input, wherein the controller divides the frequency of the clock signal input by a desired number and outputs a frequency-divided clock signal output, and the controller separates the plurality of data signal inputs and outputs a plurality of separated data signal outputs such that at least one of the separated data signal outputs has a phase that is different than another of the separated data signal outputs.

Another preferred embodiment of the present invention includes a plurality of data signal inputs, a clock signal input having a predetermined frequency, a controller that receives the plurality of data signal inputs and the clock signal input, wherein the controller divides the frequency of the clock signal input by a desired number and outputs a plurality of frequency-divided clock signal outputs, and the controller separates the plurality of data signal inputs and outputs a plurality of separated data signal outputs such that at least one of separated data signal outputs has a different phase than another of the separated data signal outputs, the clock signal outputs include a first clock signal output and a second clock signal output, the second clock signal output has a phase that is inverse of the first clock signal output, and the data signal outputs include a first group of data and a second group of data.

Another preferred embodiment of the present invention provides a liquid crystal display driving apparatus which includes a liquid crystal panel having a plurality of data lines, drive circuits for driving the plurality of data lines, a plurality of data signal inputs, a clock signal input having a predetermined frequency, a controller that receives the plurality of data signal inputs and the clock signal input, wherein the controller divides the frequency of the clock signal input by a desired number and outputs at least one frequency-divided clock signal output, the controller separates the plurality of data signal inputs and outputs a plurality of separated data signal outputs such that at least one of the separated data signal outputs has a phase that is different than another of the separated data signal outputs, and the controller outputs the separated data signal outputs and the clock signal output to the drive circuits.

Another preferred embodiment of the present invention provides a method of transmitting data which includes the steps of providing a controller, receiving a plurality of data signal inputs synchronously with a clock signal input by the controller, dividing a frequency of the clock signal input by a desired number to output at least one frequency-divided clock signal output by the controller, separating the data signal inputs into a plurality of separated data signal outputs, and phase shifting the separated data signal outputs such that at least one of the separated data signal outputs has a phase that is different than another of the separated data signal outputs for output by the controller, outputting the separated data signal outputs and the frequency-divided clock signal output by the controller.

Therefore, some of the advantages of preferred embodiments of the present invention allow for reducing the EMI at the transmission lines during parallel data transmission so as to reduce the noise generated when transmitting at higher frequencies with increased data.

Other details, features, elements and advantages of the present invention will be described in detail below with reference to preferred embodiments of the present invention and the attached drawings.

BRIEF DESCRIPTION OF THE DRAWINGS

The present invention will become more fully understood from the detailed description given herein below and the accompanying drawings which are given by way of illustration only, and thus do not limit the present invention and wherein.

DETAILED DESCRIPTION OF PREFERRED EMBODIMENTS

Figure 1:
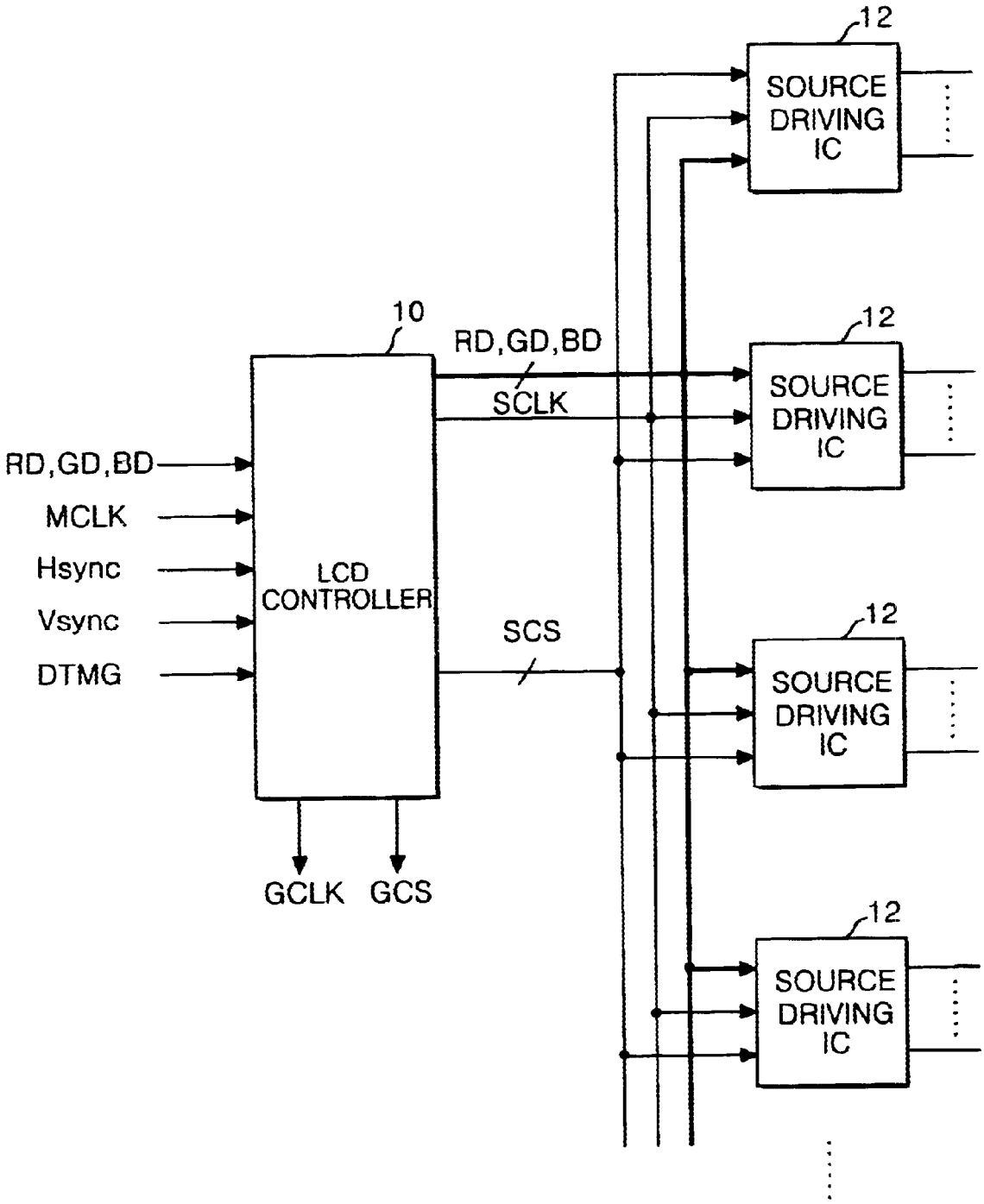
FIG. 1 PRIOR ART
FIG. 1 is a block diagram showing the configuration of a conventional LCD driving apparatus for transmitting a video data in a direct driving system.
Figure 2:
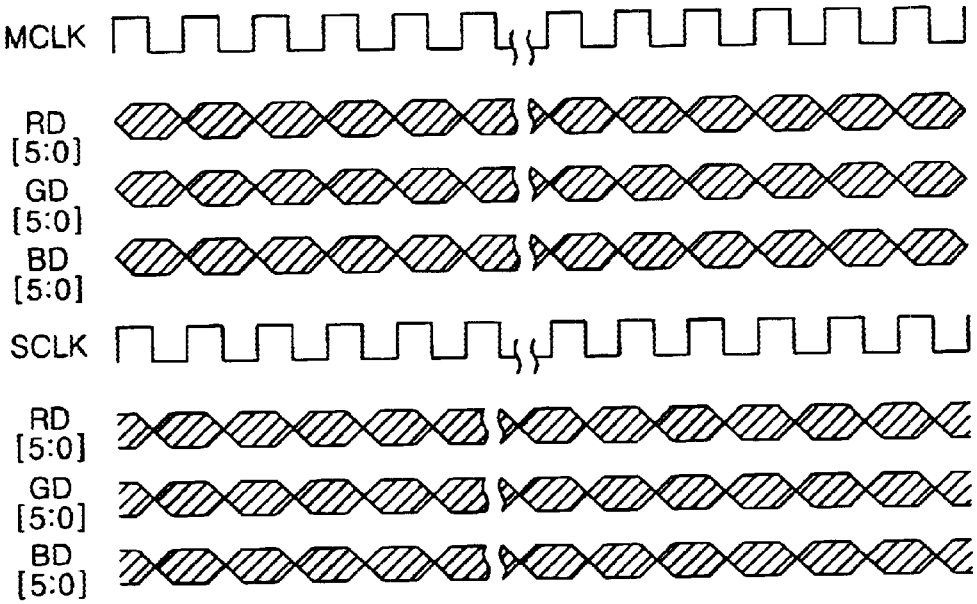
FIG. 2 PRIOR ART
FIG. 2 shows input and output signal waveforms of the LCD controller shown in FIG. 1.
Figure 3:
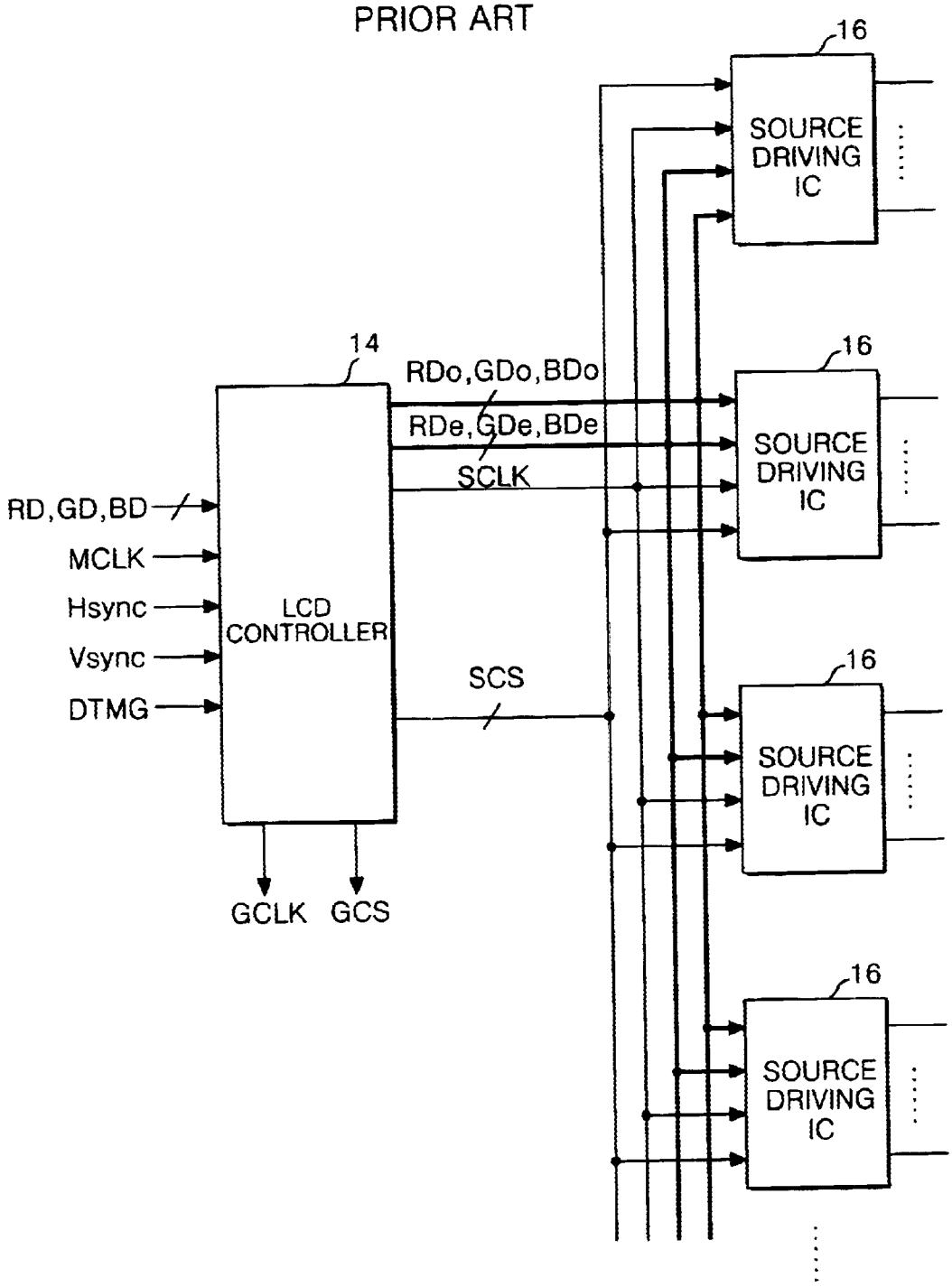
FIG.3 PRIOR ART
FIG. 3 is a block diagram of the conventional LCD driving apparatus including the dual-bus driving system.
Figure 4:
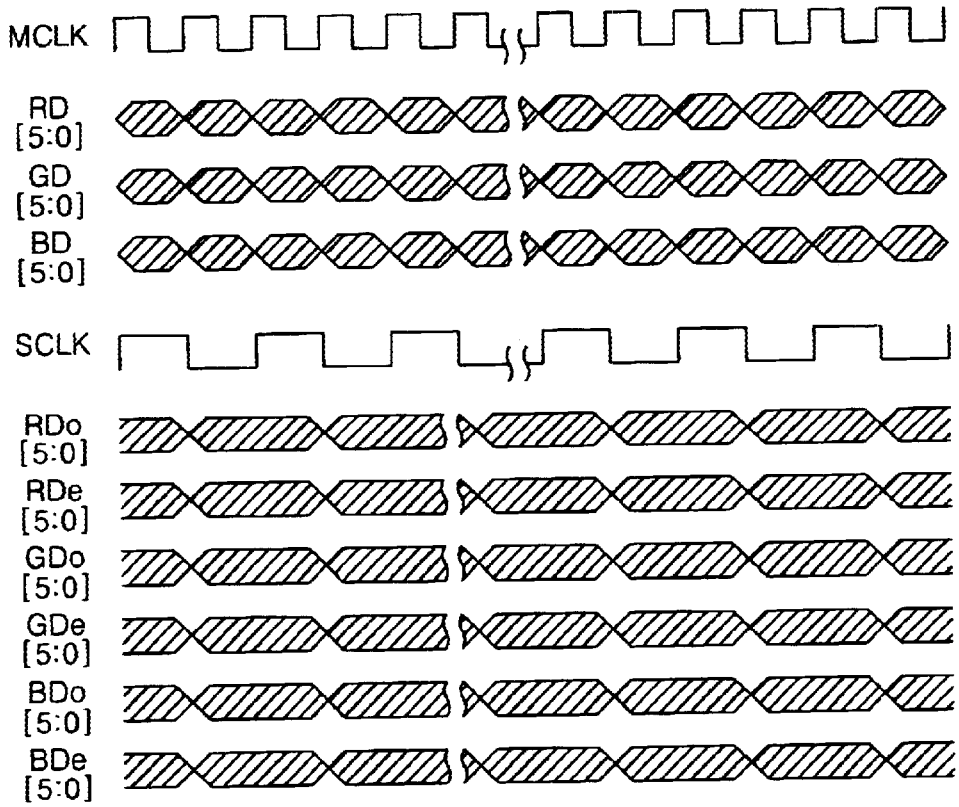
FIG. 4 PRIOR ART
FIG. 4 shows input and output signal waveforms of the LCD controller shown in FIG. 3.
Figure 7:
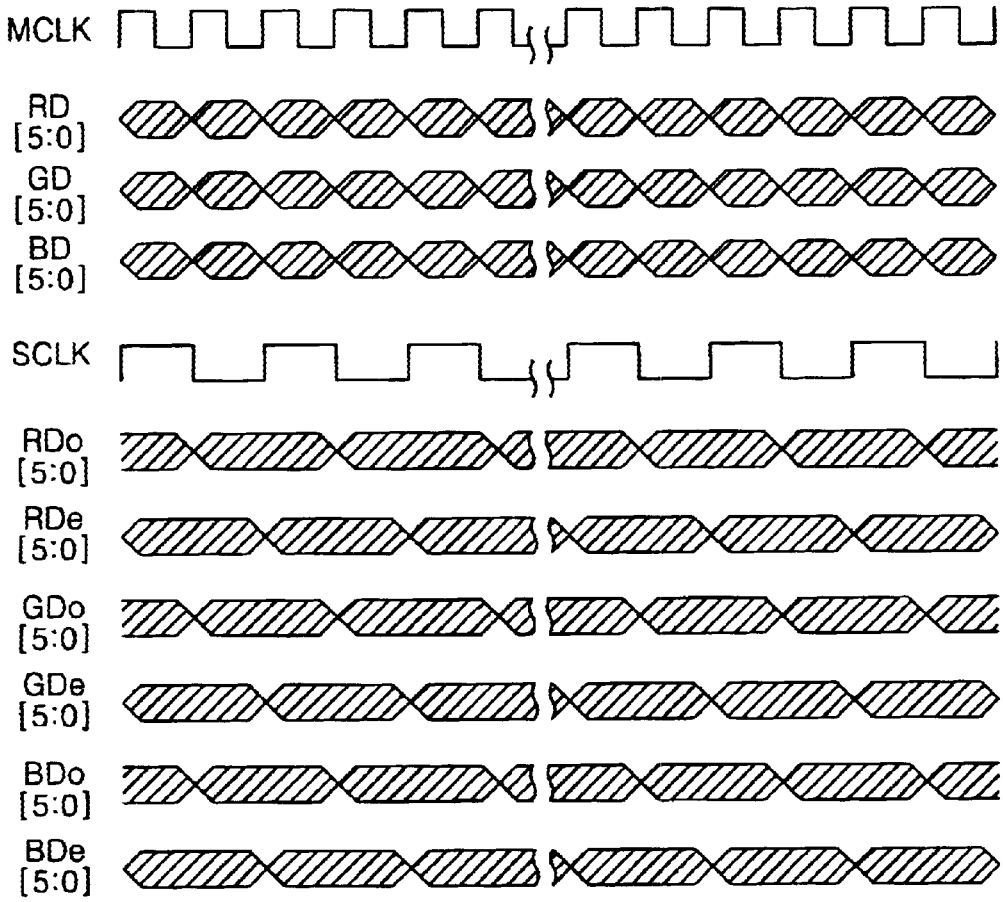
FIG. 7 shows waveform diagrams of signals that are applied to an LCD driving apparatus according to a first preferred embodiment of the present invention.

FIG. 7 shows waveform diagrams of the input and output signals of an LCD driving apparatus according to a first preferred embodiment of the present invention. Referring to FIG. 7, these signal waveforms are preferably applied to the LCD driving apparatus of the dual-bus driving system of FIG. 3, but may be applied to other data transmission systems as will be described below. In the LCD driving apparatus of FIG. 3, the LCD controller 14 is connected to the source drive ICs 16 over the first and second data buses. Now referring to FIG. 3, the LCD controller 14 preferably samples data RD, GD and BD that is input externally at the falling edge of the input clock signal MCLK, and transmits a frequency source clock signal SCLK and the data RDo, GDo, BDo, RDe, GDe and Bde, which have a frequency that is preferably about half of the input clock signal MCLK and preferably separated into odd-numbered and even-numbered pixel data for the source drive ICs 16.

In the present preferred embodiment, the LCD controller 14 transmits the odd-numbered pixel data RDo, GDo and BDo and the even-numbered pixel data RDe, GDe and BDe such that they preferably have a phase difference in order to minimize the EMI at the first and second data buses. To achieve this end, the LCD controller 14 preferably latches onto the input data RD, GD and BD data at the rising and falling edges of the source clock signal SCLK when the input data RD, GD and BD are preferably separated into the odd-numbered and even-numbered pixel data. The source drive ICs 16 preferably sample the odd-numbered pixel data RDo, GDo and BDo at the rising edge of the source clock signal SCLK, while preferably sampling the even-numbered pixel data RDe, GDe and BDe at the falling edge of the source clock signal SCLK. Accordingly, in the present preferred embodiment of the present invention, unlike the conventional art, the switching preferably does not occur simultaneously at the first and second buses between the LCD controller 14 and the source drive ICs 16 so that the EMI is greatly minimized.

Figure 5:
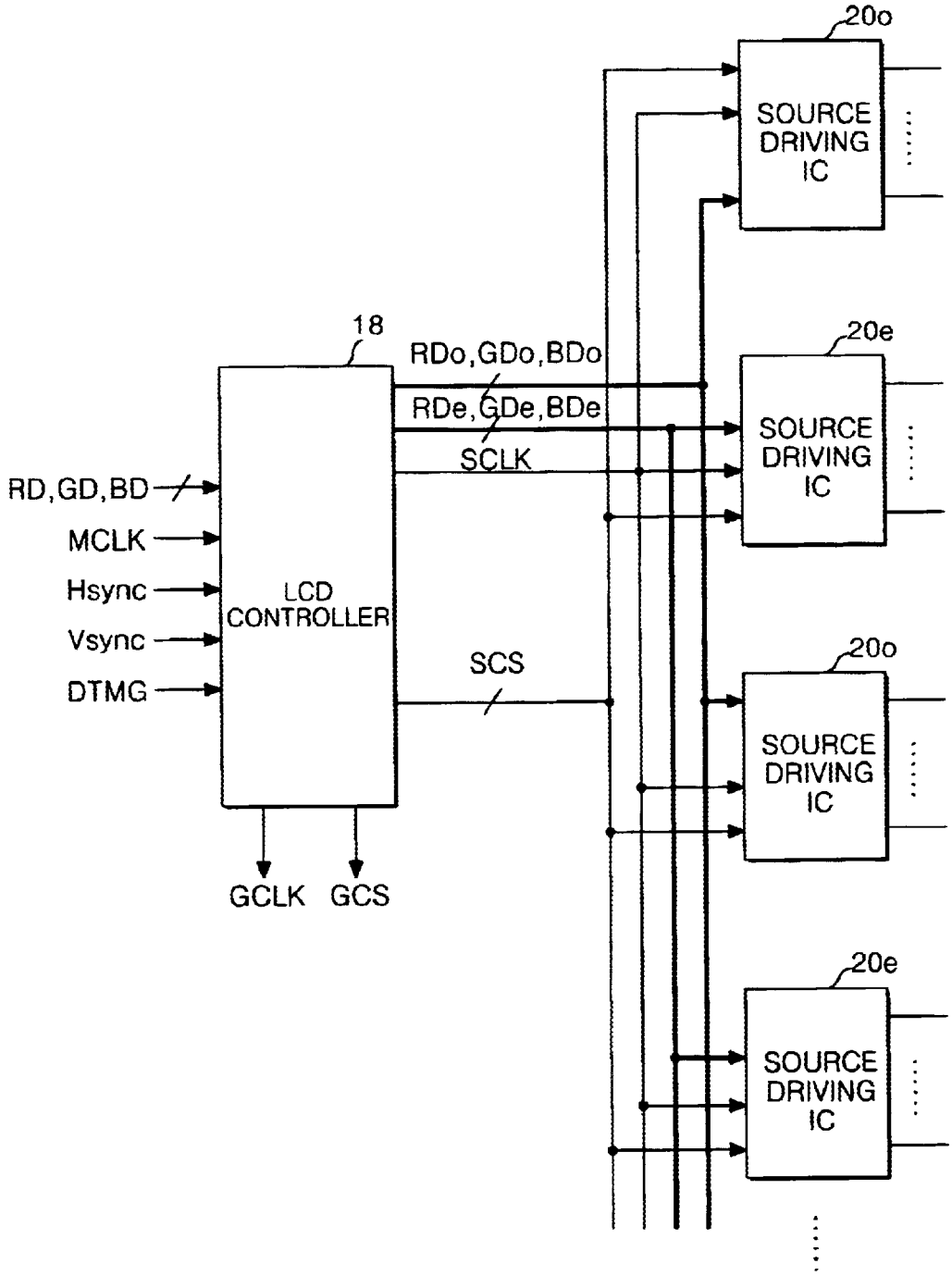
FIG.5 PRIOR ART
FIG. 5 is a block diagram of the conventional LCD driving apparatus including the dual-block driving system.
Figure 6:
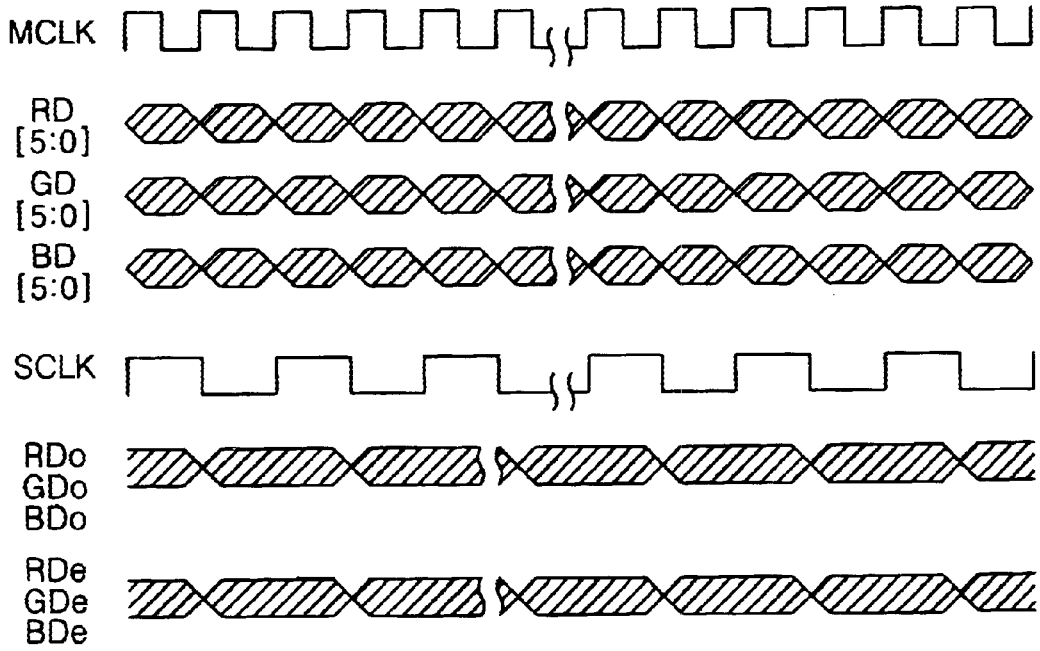
FIG.6 PRIOR ART
FIG. 6 shows waveform diagrams of the input and output signals of the LCD controller of FIG. 5.
Figure 8:
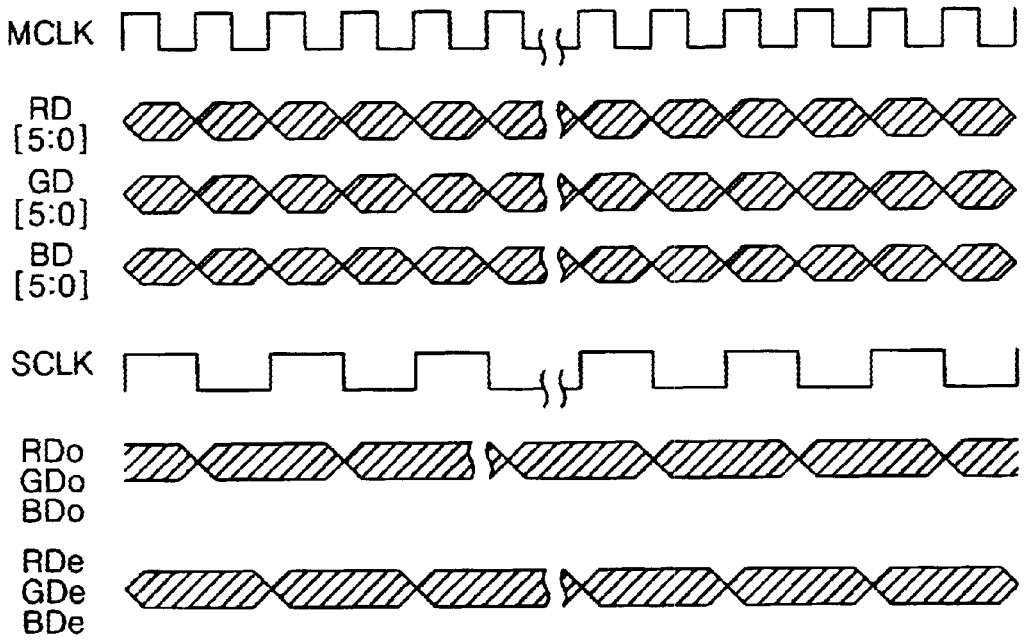
FIG. 8 shows waveform diagrams of signals that are applied to an LCD driving apparatus according to a second preferred embodiment of the present invention.

Referring now to FIG. 8, there are shown waveform diagrams of the input and output signals of the LCD driving apparatus according to a second preferred embodiment of the present invention. These signal waveforms are applied to the LCD driving apparatus of the dual-block driving system of FIG. 5. In the LCD driving apparatus of FIG. 5, the LCD controller 18 is connected to the odd-numbered source drive ICs 20*o* preferably over the first data bus and to the even-numbered source drive ICs 20*e* preferably over the second data bus. As shown in FIG. 5, the LCD controller 18 preferably samples the data RD, GD and BD that is input externally at a falling edge of an input clock signal MCLK, and separates the data into data RDo, GDo, and BDo for the odd-numbered source drive ICs 20*o* and data RDe, GDe and BDe for the even-numbered source drive ICs 20*e*. Also, the LCD controller 18 transmits the data RDo, GDo and BDo to the odd-numbered source drive ICs 20*o* and the data RDe, GDe and BDe to the even-numbered driving ICs 20*e*, respectively, in synchronization with a source clock signal SCLK that is preferably half of the frequency of the input clock signal MCLK. In the present preferred embodiment, the LCD controller 18 transmits the data RDo, GDo and BDo for the odd-numbered source drive ICs 20*o* and the data Rbe, GDe and BDe for the even-numbered source drive ICs 20*e* such that they preferably have a phase difference in order to minimize EMI at the first and second data buses. To achieve this end, the LCD controller 18 preferably latches onto the input data RD, GD and BD at the rising and falling edges of the source clock signal SCLK when the input RD, GD and BD data are separated into the data for the odd-numbered and even-numbered source drive ICs 20*o* and 20*e*. Further, the odd-numbered driving ICs 20*o* samples the data RDo, GDo and BDo for the odd-numbered source drive ICs 20*o* at the rising edge of the source clock signal SCLK, while the even-numbered driving ICs 20*e* samples the data RDe, GDe and BDe for the even-numbered source drive ICs 20*e* at the falling edge of the source clock signal SCLK. Accordingly, unlike the conventional technique, in preferred embodiments of the present invention, the switching preferably does not occur simultaneously at the first and second data buses between the LCD controller 18 and the source drive ICs 20*o* and 20*e* so that the EMI is greatly minimized.

Figure 9:
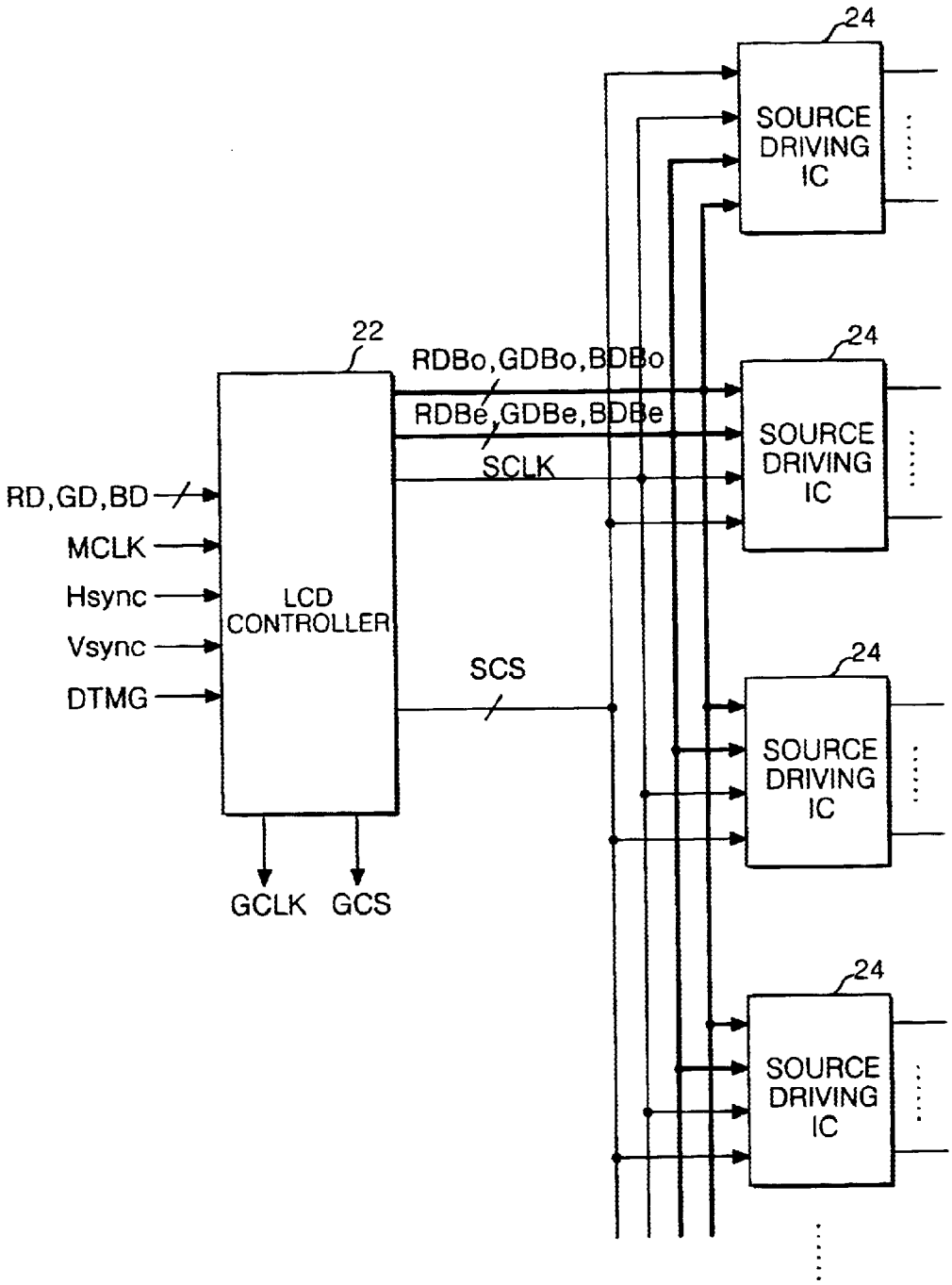
FIG. 9 is a block diagram showing an LCD driving apparatus according to a third preferred embodiment of the present invention.
Figure 10:
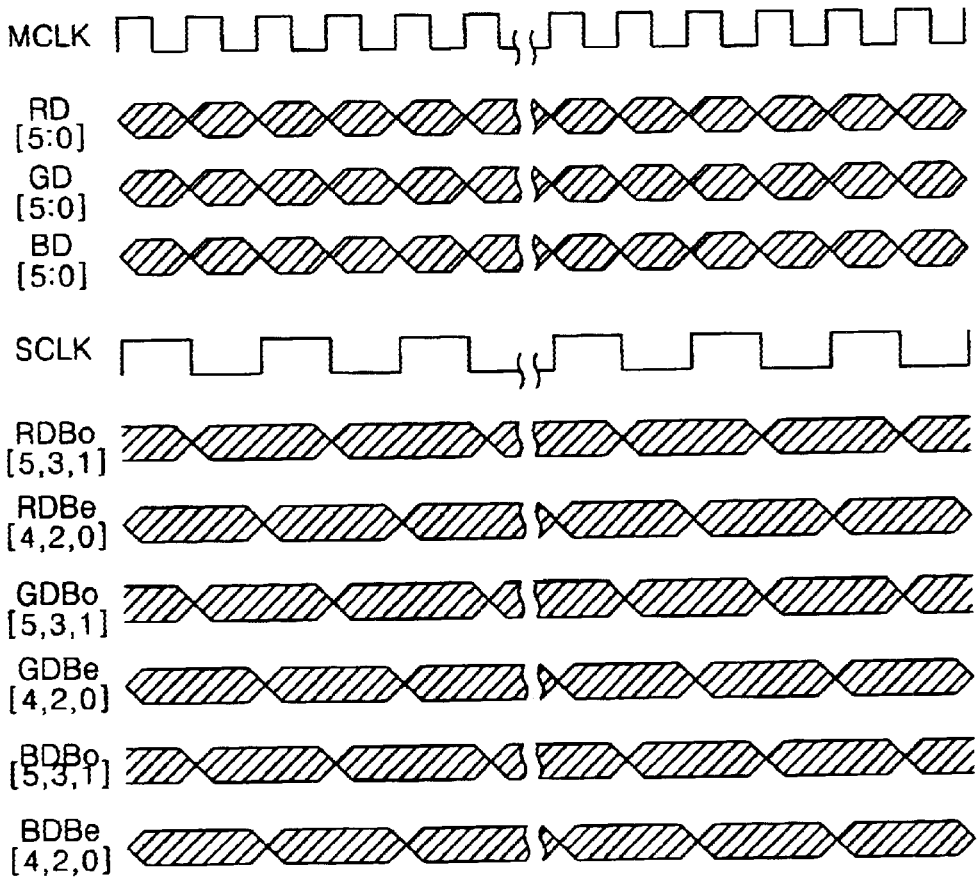
FIG. 10 shows waveform diagrams of the input and output signals of the LCD controller of FIG. 9.

Referring to FIG. 9, there is shown an LCD driving apparatus according to a third preferred embodiment of the present invention. The LCD driving apparatus includes source drive ICs 24 for driving the source lines of an LCD (not shown), and an LCD controller 22 for controlling the driving times of the source drive ICs 24. The LCD controller 22 responds to a clock signal MCLK and to horizontal and vertical synchronizing signals Hsync and Vsync that are input externally for controlling the driving times of the gate driving ICs (not shown) and the source drive ICs 24. In other words, the LCD controller 22 responds to the input clock signal MCLK and the horizontal and vertical synchronizing signals Hsync and Vsync to deliver a gate clock signal GCLK and a gate control signal GCS to control the operation of the gate driving ICs. Also, the LCD controller 22 responds to an input clock signal MCLK and the horizontal and vertical synchronizing signals Hsync and Vsync to output data RD, GD and BD that is input into an enable region of a DTMG signal to inform the video data region of the source drive ICs 24. In the present preferred embodiment, the LCD controller 22 is preferably connected to the source drive ICs 24 via the first and second data buses. As shown in FIG. 10, the LCD controller 22 preferably samples the data RD, GD and BD that is input externally at the falling edge of an input clock signal MCLK. Then, the LCD controller 22 transmits the source control signal SCS, source clock signal SCLK and the data RDo, GDo, BDo, RDe, GDe and BDe, which are separated into odd-numbered and even-numbered bits, to the source drive ICs 24. In other words, the LCD controller 22 preferably separates the data RD, GD and BD into odd-numbered bits RDBo, GDBo and BDBo and even-numbered bits RDBe, GDBe and BDBe and outputs them to the source drive ICs 24. Note that the source clock signal SCLK and the data RDo, GDo, BDb, RDe, GDe and BDe are preferably about half the frequency of the input clock signal MCLK. In the present preferred embodiment, the LCD controller 22 transmits the odd-numbered bits RDBo, GDBO and BDBo and the even-numbered bits RDBe, GDBe and BDBe such that they preferably have a phase difference in order to minimize the EMI at the first and second data buses. To achieve this result, the LCD controller 22 latches onto the input data RD, GD and BD at the rising and falling edges of the source clock signal SCLK when the input data RD, GD and BD data are separated into odd-numbered and even-numbered bits. The source drive ICs 24 preferably samples the odd-numbered bits RDBO, GDBo and BDBO at the rising edge of the source clock signal SCLK while sampling the even-numbered bits RDBe, GDBe and BDBe at the falling edge thereof. Accordingly, unlike the conventional technique, the switching does not occur simultaneously in the first and second buses that are between the LCD controller 22 and the source drive ICs 24 so that the EMI is greatly minimized.

Figure 11:
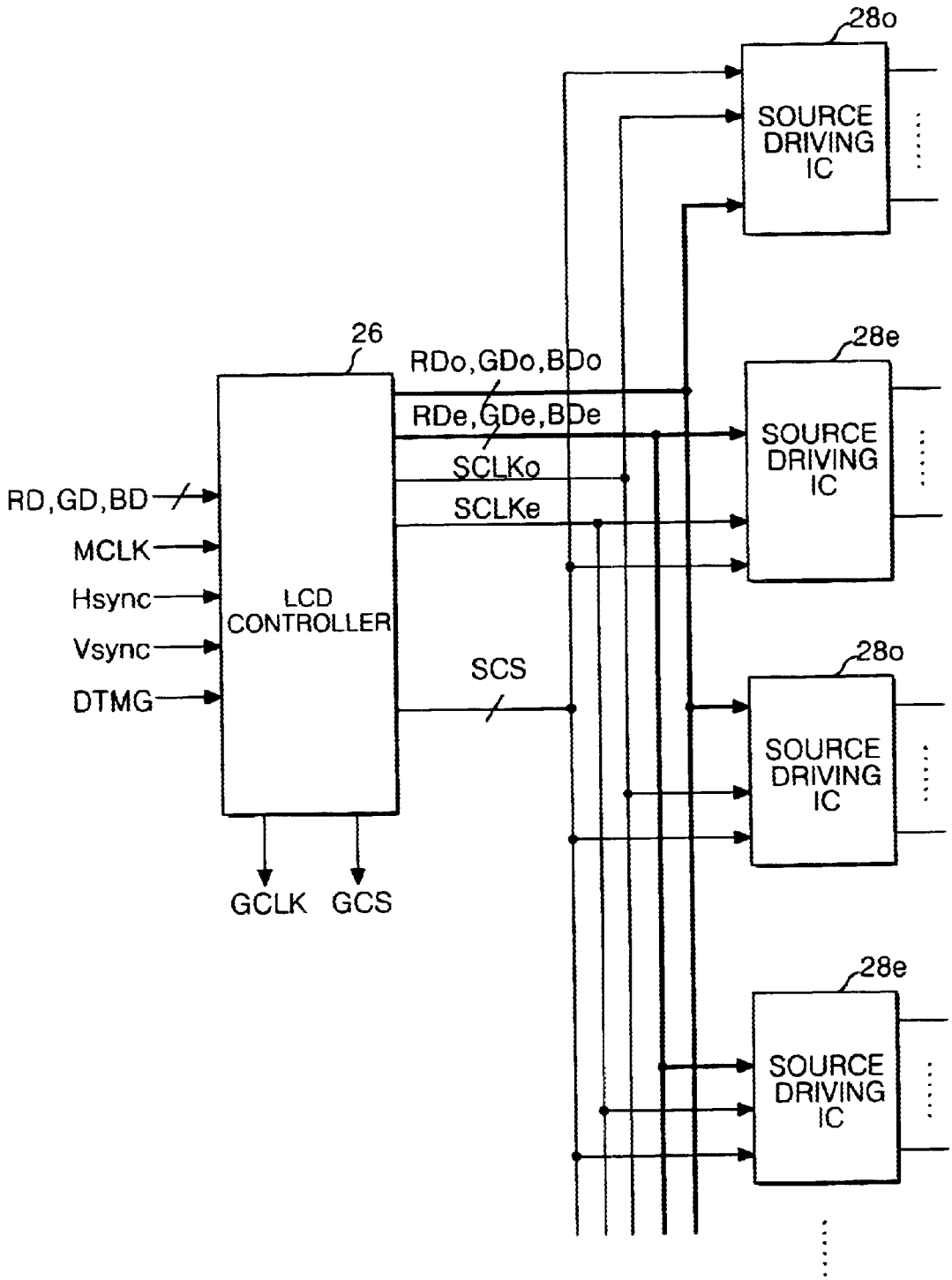
FIG. 11 is a block diagram showing an LCD driving apparatus according to a fourth preferred embodiment of the present invention.
Figure 12:
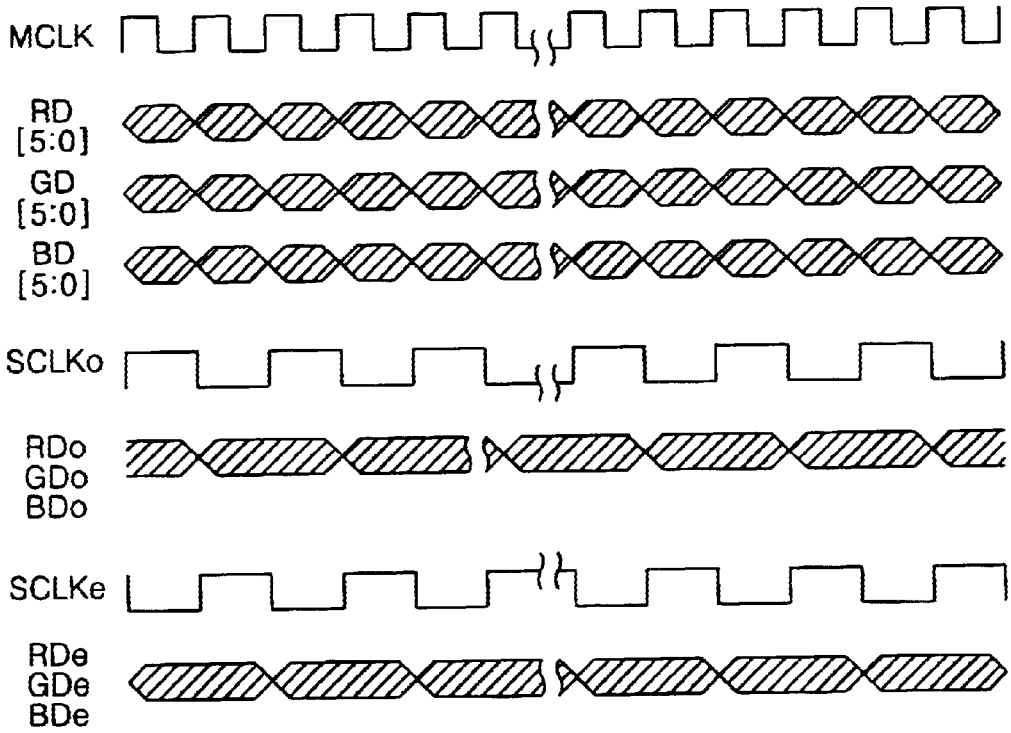
FIG. 12 shows waveform diagrams of the input and output signals of the LCD controller of FIG. 11.

Referring now to FIG. 11, there is shown an LCD driving apparatus according to a fourth preferred embodiment of the present invention. In the LCD driving apparatus of FIG. 11, an LCD controller 26 is connected to odd-numbered source drive ICs 28*o* via a first data bus, and connected to even-numbered source drive ICs 28*e* via a second data bus. As shown in FIG. 12, the LCD controller 26 samples the data RD, GD and BD that is input externally at the falling edge of an input clock signal MCLK, and separates the data into data RDo, GDo, and BDo for the odd-numbered source drive ICs 28*o* and the data RDe, GDe and BDe for the even-numbered source drive ICs 28*e*. Further, the LCD controller 26 preferably halves the frequency of the input clock signal MCLK to generate a first source clock signal SCLKo and a second source clock signal SCLKe by inverting the phase of the first source clock signal SCLKo. The LCD controller 26 transmits the data RDo, GDo and BDo to the odd-numbered source drive ICs 28*o* synchronized with the first source clock signal SCLKo, which is transmitted over the first source clock line. Further, The LCD controller 26 transmits the data RDe, GDe and BDe to the even-numbered source drive ICs 28*e* synchronized with the second source clock signal SCLKe, which is transmitted over the second source clock line. In the present preferred embodiment, the LCD controller 26 transmits the data RDo, GDo and BDo for the odd-numbered source drive ICs 28*o* and the data RDe, GDe and BDe for the even-numbered source drive ICs 28*e* such that they have a phase difference in order to minimize the EMI at the first and second data buses. To this end, the LCD controller 26 preferably latches onto the input data RD, GD, and BD at the rising and falling edges of the source clock signal SCLK when the input data RD, GD and BD are separated into the data for the odd-numbered and even-numbered source drive ICs 28*o* and 28*e*. Further, the odd-numbered source drive ICs 28*o* preferably samples the data RDo, GDo and BDo at the rising edge of the first source clock signal SCLKo, while the even-numbered driving lCs 28*e* also samples the data RDe, GDe and BDe at the rising edge of the second source clock signal SCLKe.

Accordingly, unlike the conventional technique, the switching does not occur simultaneously in the first and second data buses between the LCD controller 26 and the source drive ICs 28*o* and 28*e* so that the EMI is greatly minimized. Further, the use of two source clocks preferably with inverse phase cancels the magnetic flux that is created by the clock pulse such that there is further reduction in the EMI. Note that since the source drive ICs 28*o* and 28*e* sample the RD, GD, and BD data at the rising edge (or the falling edge) of the first or second source clock signal SCLKo or SCLKe, the existing drive ICs can be used as they were conventionally.

As described above, the data transmitting apparatus and method according to preferred embodiments of the present invention transmits data that is transferred in parallel by separating the data and introducing a phase difference between the separated data so that simultaneous switching is avoided and the EMI that is generated during data transmission is greatly minimized.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A data transmitting system, comprising:

a plurality of data signal inputs;

a clock signal input having a predetermined frequency; and a controller arranged to receive the plurality of data signal inputs and the clock signal input, wherein the controller divides the frequency of the clock signal input by a desired number and outputs a frequency-divided clock signal output, and the controller separates the plurality of data signal inputs and outputs a plurality of separated data signal outputs such that at least one of the separated data signal outputs has a phase that is different from another of the separated data signal outputs, the separated data signal outputs including a plurality of odd-numbered pixel data and even-numbered pixel data, the odd-numbered pixel data and the even-numbered pixel data having a phase that is different from each other, wherein the odd-numbered pixel data are sampled at a rising edge of the clock signal output, and the even-numbered pixel data are sampled at a falling edge of the clock signal output.

2. The system of claim 1, further comprising:

a plurality of clock signal lines for transmitting the clock signal output;

a plurality of drive integrated circuits; and a plurality of data buses for transmitting the plurality of separated data signal outputs, wherein the data signal outputs are transmitted via the data buses and the frequency-divided clock signal output is transmitted via the clock signal lines as inputs for the drive integrated circuits.

3. A data transmitting system, comprising:

a plurality of data signal inputs;

a plurality of driving integrated circuits;

a clock signal input having a predetermined frequency; and a controller arranged to receive the plurality of data signal inputs and the clock signal input, wherein the controller divides the frequency of the clock signal input by a desired number and outputs a frequency-divided clock signal output, and the controller separates the plurality of data signal inputs and outputs a plurality of separated data signal outputs such that at least one of the separated data signal outputs has a phase that is different than another of the separated data signal outputs, the separated data signal outputs including a first group of odd-numbered bits and a second group of even-numbered bits, the first group of odd-numbered bits having a phase that is different from the second group of even-numbered bits, wherein the driving integrated circuits sample the first group of odd-numbered bits at a rising edge of the clock signal output and the second group of even-numbered bits at a falling edge of the clock signal output.

4. A data transmitting system, comprising:

a plurality of data signal inputs;

a clock signal input having a predetermined frequency; and a controller arranged to receive the plurality of data signal inputs and the clock signal input, wherein the controller:

divides the frequency of the clock signal input by a desired number and outputs a frequency-divided clock signal output, separates the plurality of data signal inputs and outputs a plurality of separated data signal outputs such that at least one of the separated data signal outputs has a phase that is different from another of the separated data signal outputs, and outputs the first group of data to a first data bus that is connected to a plurality of odd-numbered drive integrated circuits and the second group of data to a second data bus that is connected to a plurality of even-numbered drive integrated circuits, the first group of data having a phase that is different from the second group of data, wherein the odd-numbered drive integrated circuits sample the first group of data at a rising edge of the clock signal output, and the even-numbered drive integrated circuits sample the second group of data at a falling edge of the clock signal output.

5. A data transmitting system, comprising:

a plurality of data signal inputs;

a clock signal input having a predetermined frequency; and a controller arranged to receive the plurality of data signal inputs and the clock signal input, wherein the controller divides the frequency of the clock signal input by a desired number and outputs a frequency-divided clock signal output, the controller separating the plurality of data signal inputs and outputting a plurality of separated data signal outputs such that at least one of the separated data signal outputs has a phase that is different from another of the separated data signal outputs;

a clock signal output including a first clock signal output and a second clock signal output, the second clock signal output having a phase that is inverse of a phase of the first clock signal output;

a plurality of clock lines;

a plurality of drive integrated circuits including odd-numbered and even numbered drive integrated circuits; and a plurality of data buses, wherein:

the first group of data is transmitted via a first of the data buses and the first clock signal output is transmitted via a first clock line to the odd-numbered integrated circuits, the first group of data is sampled by the odd-numbered integrated circuits at a rising edge of the first clock signal output, the second group of data is transmitted via a second data bus and the second clock signal output is transmitted via a second clock line to the even-numbered drive integrated circuits, and the second group of data is sampled by the even-numbered integrated circuits at a rising edge of the second clock signal output.

6. A data transmitting method, comprising the steps of:

providing a controller;

receiving a plurality of data signal inputs synchronously with a clock signal input by the controller;

dividing a frequency of the clock signal input by a desired number to output at least one frequency-divided clock signal output by the controller;

separating the data signal inputs into a plurality of separated data signal outputs, and phase shifting the separated data signal outputs such that at least one of the separated data signal outputs has a phase that is different than another of the separated data signal outputs for output by the controller;

outputting the separated data signal outputs and the frequency-divided clock signal output by the controller, wherein the step of separating the data signal inputs includes grouping the separated data signal outputs into odd-numbered pixel data and even-numbered pixel data, and the step of receiving the outputs of the controller includes sampling the odd-numbered pixel data at a rising edge of the clock signal output by the drive circuits and the even-numbered pixel data at a falling edge of the clock signal output by the drive circuits.

7. A data transmitting method, comprising the steps of:

providing a controller;

receiving a plurality of data signal inputs synchronously with a clock signal input by the controller;

dividing a frequency of the clock signal input by a desired number to output at least one frequency-divided clock signal output by the controller;

separating the data signal inputs into a plurality of separated data signal outputs, and phase shifting the separated data signal outputs such that at least one of the separated data signal outputs has a phase that is different than another of the separated data signal outputs for output by the controller;

outputting the separated data signal outputs and the frequency-divided clock signal output by the controller, wherein the step of separating the data signal inputs includes grouping the separated data signal outputs into odd-numbered bits and even-numbered bits, and the step of receiving the outputs of the controller includes sampling the odd-numbered bits at a rising edge of the clock signal outputs and the even-numbered bits at a falling edge of the clock signal output.

8. A data transmitting method, comprising the steps of:

providing a controller;

receiving a plurality of data signal inputs synchronously with a clock signal input by the controller;

dividing a frequency of the clock signal input by a desired number to output at least one frequency-divided clock signal output by the controller;

separating the data signal inputs into a plurality of separated data signal outputs, and phase shifting the separated data signal outputs such that at least one of the separated data signal outputs has a phase that is different than another of the separated data signal outputs for output by the controller;

outputting the separated data signal outputs and the frequency-divided clock signal output by the controller, wherein:

the step of separating the data signal inputs includes grouping the separated data signal outputs into a first group of data corresponding to even-numbered drive circuits and a second group of data corresponding to odd-numbered drive circuits, the step of dividing the frequency of the clock signal input includes generating a first and second clock signal output where the second clock signal output has a phase that is an inverse of a phase of the first clock signal output, and the step of receiving the outputs of the controller includes sampling the first group of data in synchronization with a rising edge of the first clock signal output by the odd-numbered drive circuits and sampling the second group of data in synchronization with a rising edge of the second clock signal output by the even-numbered drive circuits.

9. The method of claim 6, wherein the method is applied to a liquid crystal display panel.

10. The method of claim 7, wherein the method is applied to a liquid crystal display panel.

11. The method of claim 8, wherein the method is applied to a liquid crystal display panel.

* * * * *